US005620348A

United States Patent [19]

Santana et al.

[11] Patent Number: 5,620,348

[45] Date of Patent: Apr. 15, 1997

[54] METHOD OF MANUFACTURING ELECTROLUMINESCENT LAMPS HAVING SURFACE DESIGNS AND LAMPS PRODUCED THEREBY

[75] Inventors: Jose Santana; Harold Thorgersen, both of Woodbury, Conn.; John Dixon, London, England; Andrew C. Ledesma, Cebu, Philippines

[73] Assignee: Timex Corporation, Middlebury, Conn.

[21] Appl. No.: 439,840

[22] Filed: May 12, 1995

[51] Int. Cl.[6] ..... H05B 33/10; H05B 33/02

[52] U.S. Cl. ..... 445/24; 427/66; 313/506; 362/84

[58] Field of Search ..... 445/24; 427/66; 313/506, 111, 110; 362/84

[56] References Cited

U.S. PATENT DOCUMENTS

| | | | |
|---|---|---|---|
| 4,196,973 | 4/1980 | Hochstrate | 350/338 |
| 4,602,189 | 7/1986 | Panicker | 313/506 |
| 4,775,964 | 10/1988 | Alessio et al. | 368/67 |
| 5,072,152 | 12/1991 | Tuenge et al. | 427/66 |
| 5,142,192 | 8/1992 | Takahashi et al. | 313/506 |
| 5,184,969 | 2/1993 | Sharpless et al. | 445/24 |
| 5,346,718 | 9/1994 | Thorgersen et al. | 427/66 |

FOREIGN PATENT DOCUMENTS

| | | | |
|---|---|---|---|
| 60-177600 | 9/1985 | Japan | 362/84 |
| 2110875 | 6/1983 | United Kingdom | 313/506 |

*Primary Examiner*—Kenneth J. Ramsey
*Assistant Examiner*—Jeffrey T. Knapp
*Attorney, Agent, or Firm*—William C. Crutcher

[57] ABSTRACT

The method and structure for providing surface designs to electroluminescent (EL) lamps involves two essential steps. First, a layer of transflective material is introduced to the EL lamp comprising a transparent substrate and front and back electrodes sandwiching an electroluminescent layer and an insulating layer. The layer of transflective material reflects incident ambient light and transmits light emitted by an energized electroluminescent layer. In the preferred embodiment of the invention, the layer of transflective material replaces the front electrode of the EL lamp. Second, a predetermined surface design is provided to the transparent substrate to enhance diffusion and fringing of both the reflected incident ambient light and the light emitted by the energized electroluminescent layer. This enhanced diffusion and fringing leads to a visually appealing appearance.

21 Claims, 4 Drawing Sheets

METHOD OF MANUFACTURING ELECTROLUMINESCENT LAMPS HAVING SURFACE DESIGNS AND LAMPS PRODUCED THEREBY

BACKGROUND OF THE INVENTION

This invention relates to a method of manufacturing electroluminescent lamps having surface designs and to lamps produced by this method.

As is well known in the art (e.g., see U.S. Pat. No. 5,346,718 issued on Sep. 13, 1994 and assigned to the present assignee), electroluminescent (EL) lamps are generally constructed as laminated or layered structures. FIG. 1 illustrates a side elevational view in cross section of an archetypal, prior art EL lamp 10. The drawing is not to scale, and the layers are greatly enlarged for purposes of illustration, it being understood that some of the layers referred to herein are quite thin. Furthermore, the bottom layer in the drawing is in actuality the face of the EL lamp 10 (the drawing shows the EL lamp 10 upside-down because this is how the different layers are deposited). The EL lamp 10 comprises a transparent substrate 11 having deposited thereon a first conductive layer 12. Note that the transparent substrate 11 serves as the face of the EL lamp 10. Commercially, the substrate 11 with the conductive layer 12 already on it is available in the form of Mylar™ (a registered trademark of E.I. duPont de Nemours & Co.) having an indium tin oxide (ITO) coating. On the first conductive layer 12, which may also be referred to as the front electrode, an electroluminescent layer 13 is deposited by silk screening or another suitable process. The electroluminescent layer 13, as known, comprises electroluminescent particles such as ZnS:Cu which are thoroughly mixed in a polymerizable resin, with the resin being subsequently polymerized. On the electroluminescent layer 13, an insulating layer 14 is deposited. The insulating layer 14 may be composed of barium titanate or other appropriate dielectrics, preferably having light reflective qualities. Finally, a second conductive layer 15, which may also be referred to as the back electrode, is deposited on the insulating layer 14. The second conductive layer 15 also preferably has light reflective qualities. The insulating layer 14 serves to maintain an electrical separation between the first and second conductive layers 12, 15.

Generally, the front electrode 12 is highly transparent to permit as much of the light emitted by an energized electroluminescent layer 13 to reach the face 11 of the EL lamp 10 as possible. As is known, the electroluminescent layer 13 is energized by application of an electrical potential between the front and back electrodes 12, 15. The problem with utilizing a highly transparent front electrode in an EL lamp is the dull, visually unappealing appearance whenever the electroluminescent layer is not energized. This is because no means are provided to adequately reflect the incident ambient light entering the face of the EL lamp. Without adequate reflection of the incident ambient light, the resin/electroluminescent particles mixture comprising the electroluminescent layer 13 appears dull and unappealing when not energized. Thus, it is one object of the present invention to provide an improved EL lamp which can adequately reflect incident ambient light, and the method of making the same.

It is another object of the present invention to provide an improved EL lamp which can adequately reflect incident ambient light and also transmit light emitted by the electroluminescent layer, and the method of making the same.

Another object of the present invention is to provide an improved EL lamp, the face of which has a predetermined configuration, and the method of making the same.

Yet another object of the present invention is to provide an improved EL lamp having lacquer of predetermined color applied to its face, and the method of making the same.

EL lamps have been modified to provide a lighted timepiece dial, as disclosed in U.S. Pat. No. 4,775,964 issued on Oct. 4, 1988 to Alessio et al. and assigned to the present assignee. Thus, still another object of the present invention is to provide an improved EL lamp, serving as an EL dial, having horological markings on its face, and the method of making the same.

SUMMARY OF THE INVENTION

Briefly stated, the present invention is an improved method of manufacturing an electroluminescent lamp of the type having a transparent substrate with top and bottom surfaces, and front and back electrodes having interposed therebetween an electroluminescent layer and an insulating layer. The improvement comprises adapting the front electrode to reflect incident ambient light and transmit light received from the electroluminescent layer when the electroluminescent layer is energized, and providing the transparent substrate with a predetermined surface configuration on one surface to enhance the diffusion and flinging of the reflected incident ambient light and the light emitted by the electroluminescent layer when energized.

BRIEF DESCRIPTION OF THE DRAWINGS

The invention, both as to organization and to method of practice, together with further objects and advantages thereof, will best be understood by reference to the following specification, taken in connection with the accompanying drawings, in which.

DETAILED DESCRIPTION OF THE PREFERRED EMBODIMENT

Figure 1:
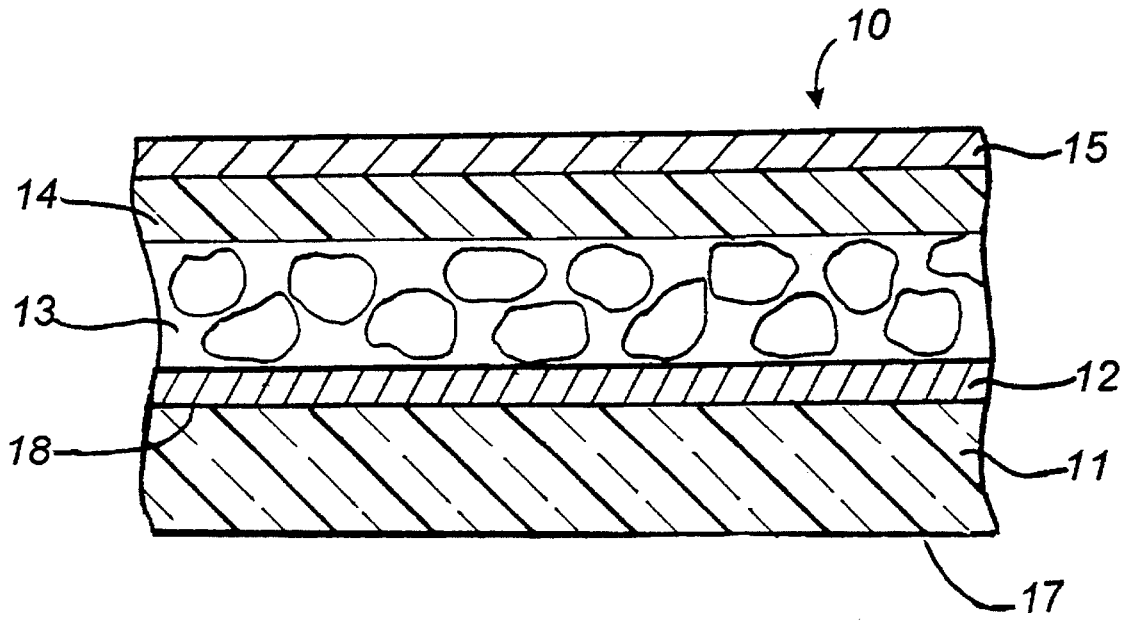
Fig. 1 Prior Art
FIG. 1 is an enlarged side elevational view in cross section of an archetypal, prior art EL lap.
Figure 2:
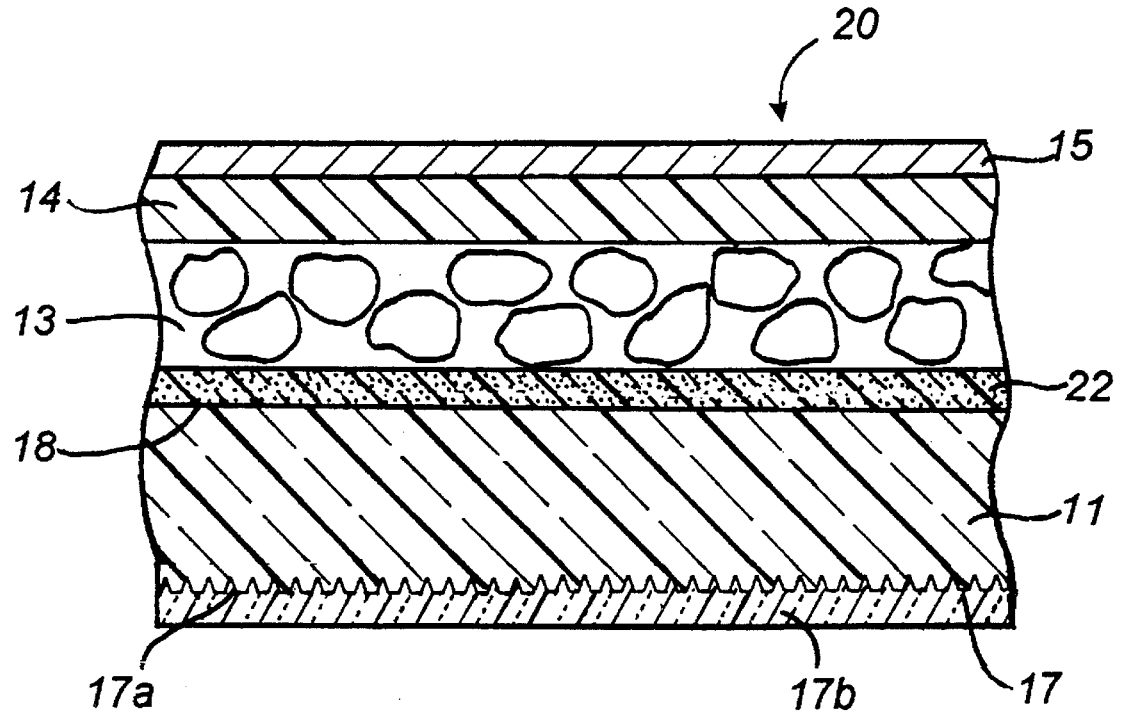
FIG. 2, is an enlarged side elevational view in cross section of an EL lamp in accordance with the preferred embodiment of the present invention.
Figure 3A:
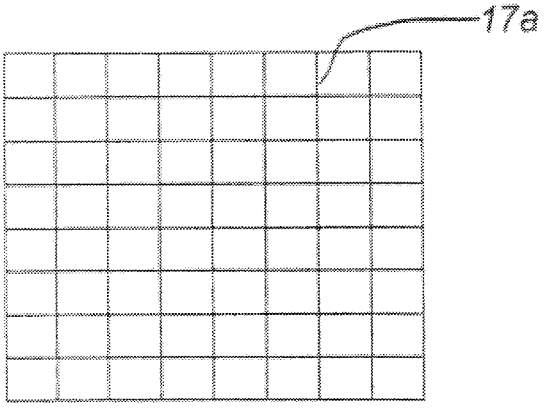
FIGS. 3*a*–3*d* illustrate predetermined configurations to be provided to the face of the EL lamp of FIG. 2.
Figure 3B:
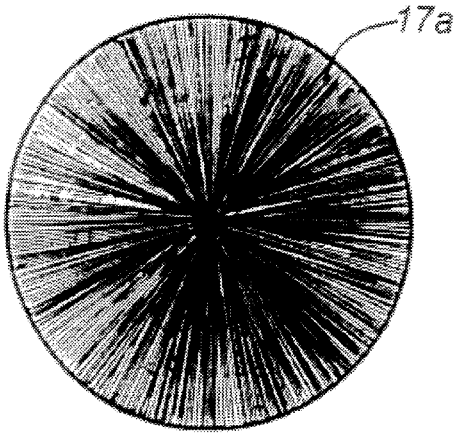
Figure 3C:
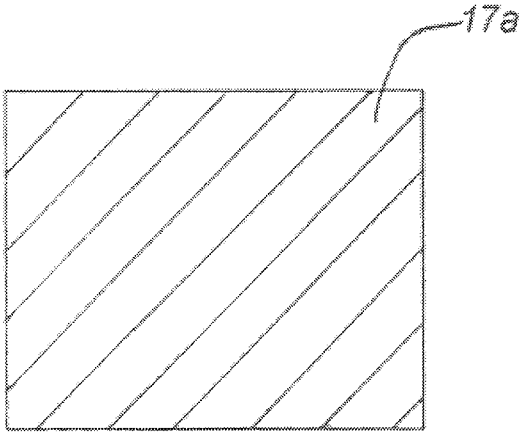
Figure 3D:
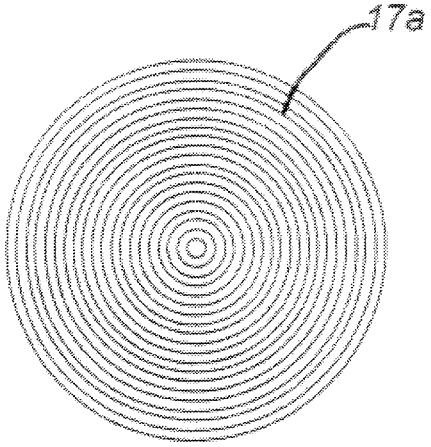

In the preferred embodiment of an EL lamp 20 of the present invention, shown in FIG. 2, the highly transparent front electrode 12 of FIG. 1 is replaced by a front electrode 22 which functions essentially as a one-way mirror, so that incident ambient light is reflected by the front electrode 22, while the light emitted by an energized electroluminescent layer is transmitted through the front electrode 22 to the face of the EL lamp. Such a transmissive/reflective front electrode 22 will be referred to hereinafter as a transflective front electrode. Note that the rest of the layers of FIG. 2 are the same as in FIG. 1. The transflective front electrode 22 comprises conductive materials which are translucent to light, such as a thin layer of metallic particles applied over the transparent substrate 11 by vacuum vapor deposition or other appropriate uniformly depositing process. Preferably, the metallic particles used are aluminum. The minimum effective thickness required for the transflective front electrode 22 depends upon several factors, including the type of translucent material utilized. For example, it has been found that for aluminum, a thickness of 500 to 1000 angstroms (Å) proves satisfactory in achieving the objects and advantages of the invention where the approximate thicknesses of the other layers are as follows: the transparent substrate 11 is 5 to 7 mils (1 mil=$25.4\times10^{-6}$ m); the electroluminescent layer 13 is 1.5 mils; the insulating layer 14 is 0.1 mil; and the back electrode 15 is 0.5 mil. As is known, a thickness of 500 to 1000 Å (Å=$10^{-10}$ m) corresponds to the thickness of the indium tin oxide (ITO) transparent front electrode currently available commercially (deposited on Mylar™).

FIGS. 3*a*–3*d* illustrate four possible predetermined surface configurations 17*a* to be provided to the face of the EL lamp 20; i.e., the transparent substrate 11. In order, FIGS. 3*a*–3*d* show a checkered configuration, a sunburst configuration, a diagonal configuration and a concentric circles configuration. These configurations 17*a* may be provided on either the top surface 17 (surface away from the transflective front electrode 22) or the bottom surface 18 (surface adjacent the transflective front electrode 22) of the transparent substrate 11. Preferably, however, the configurations 17*a* are provided on the top surface 17, as shown in FIG. 2. In the present invention, each configuration 17*a* is formed by scratching the transparent substrate 11 with an abrasive instrument, preferably a metallic brush, mounted on appropriate machinery. The predetermined surface configurations 17*a* shown in plan views in FIGS. 3*a*–3*d* are preferably formed after the layers of the EL lamp 20 have been laminated together; e.g., by employing heat and/or pressure.

Providing the face 11 of the EL lamp 20 with a predetermined surface configuration 17*a* serves an important aesthetic objective. By causing the transparent substrate 11 surface upon which it is formed to have a roughened contour, the configuration 17*a* enhances the diffusion and fringing of both the reflected incident ambient light and the light emitted by an energized electroluminescent layer 13. This enhanced diffusion and fringing provides a visually appealing appearance to the EL lamp 20 heretofore unavailable in EL lamps. The effect is akin to the effect created by surface designs on metallic, non-EL lamps, such as the metallic dials used in analog timepieces.

Figure 4A:
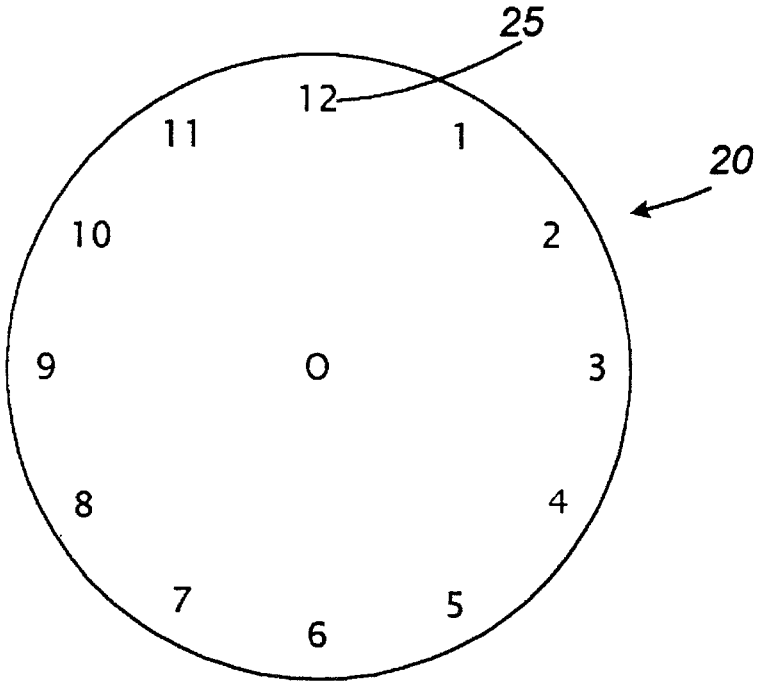
FIGS. 4*a* and 4*b* show indicia which are to be provided to the face of the EL lamp, where the EL lamp is serving as an analog timepiece dial.
Figure 4B:
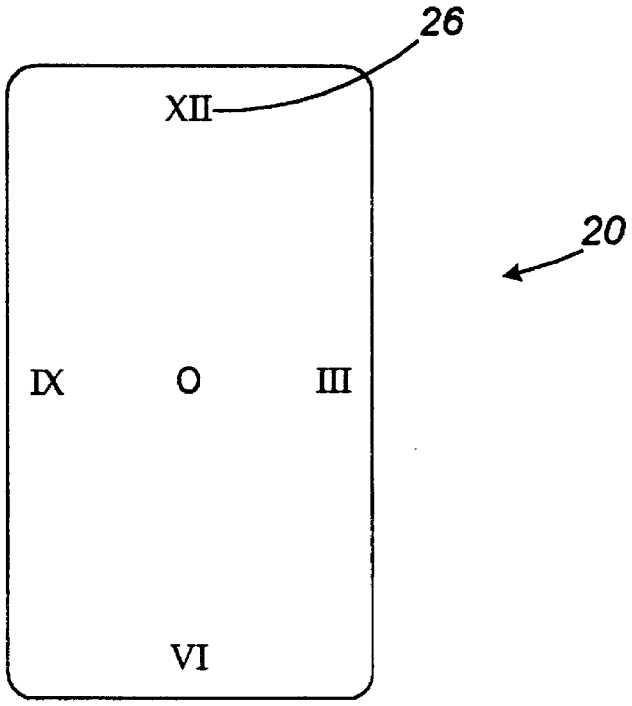

Subsequent to the predetermined surface configuration 17*a* being formed, the top surface 17 of the transparent substrate 11 may be lacquered to provide a smooth, glossy finish, as indicated by layer 17*b* in FIG. 2. The lacquer 17*b* applied may be clear or of a predetermined color. Furthermore, where the EL lamp 20 is to be used as an analog timepiece dial, indicia 25 and 26, as are shown in FIGS. 4*a* and 4*b* respectively, may be printed onto the top surface 17 (with or without lacquer 17*b*) of the transparent substrate 11 by transfer printing or silk screening, employing conventional techniques of the same type which are presently used to manufacture conventional timepiece dials (see the aforementioned '964 patent). FIG. 4*a* illustrates a circular-cut EL lamp 20 with number indicia 25, while FIG. 4*b* illustrates a rectangular-cut EL lamp 20 with Roman numeral indicia 26. Where three-dimensional indicia are desired, they may be formed by a method disclosed in the co-pending application of Santana et al., Ser. No. 08/387693, filed on Feb. 13, 1995.

Figure 5:
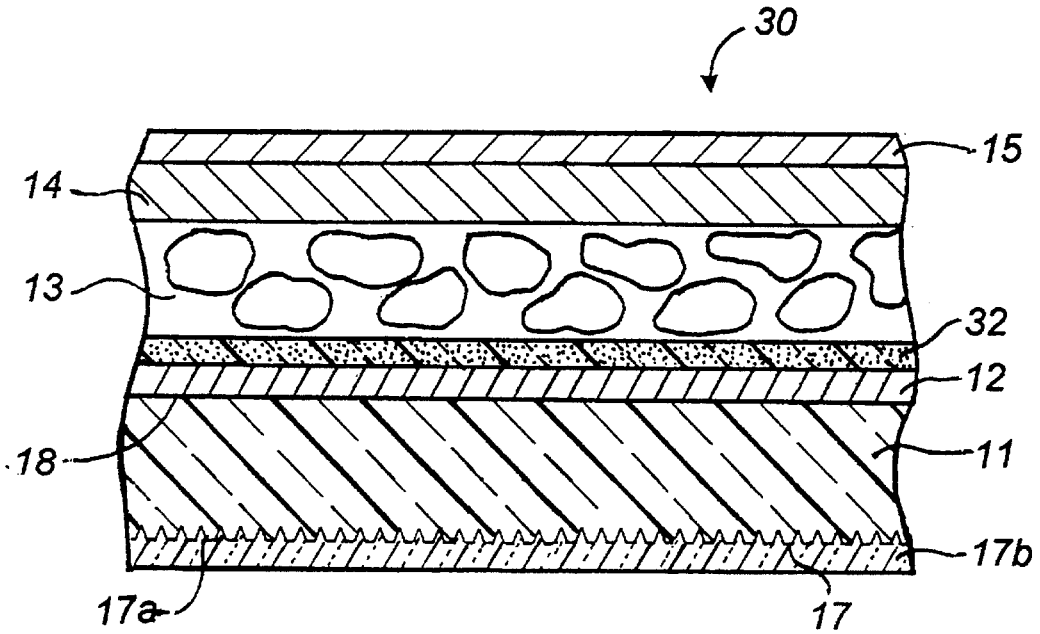
FIG. 5 is an enlarged side elevational view in cross section of an EL lamp in accordance with the second embodiment of the present invention.

In a second embodiment of an EL timepiece lamp 30 of the present invention, rather than replacing the highly transparent front electrode 12 of FIG. 1 with the transflective front electrode 22, as was done in FIG. 2, a layer of transflective material 32 is deposited on the transparent front electrode 12. This is shown in FIG. 5. On the layer of transflective material 32, the electroluminescent layer 13 is deposited. The rest of the layers are as described for FIG. 1. Similar to the transflective front electrode 22 of the preferred embodiment, the transflective layer 32 comprises materials which are translucent to light. However, unlike the transflective front electrode 22, these materials need not be conductive since the transparent front electrode 12 is present. The minimum effective thickness of the transflective layer 32 depends upon several factors, including the type of translucent material utilized. Generally, the transflective layer 32 should be slightly thinner than the transflective front electrode 22 of FIG. 2 to compensate for some light absorption by the highly transparent front electrode 12 present. Thus, where thickness of 500 to 1000 Å is appropriate for an aluminum transflective front electrode 22, thickness on the order of 500 Å is appropriate for an aluminum transflective layer 32.

The transparent substrate 11 of FIG. 5 is provided with a predetermined surface configuration 17*a*, as is done for the preferred embodiment of FIG. 2. Following the formation of the predetermined configuration in the form of minute scratches 17*a*, the top surface 17 (surface away from the transparent front electrode 12) of the transparent substrate 11 may be provided with a layer of lacquer 17*b* and/or indicia.

Figure 6:
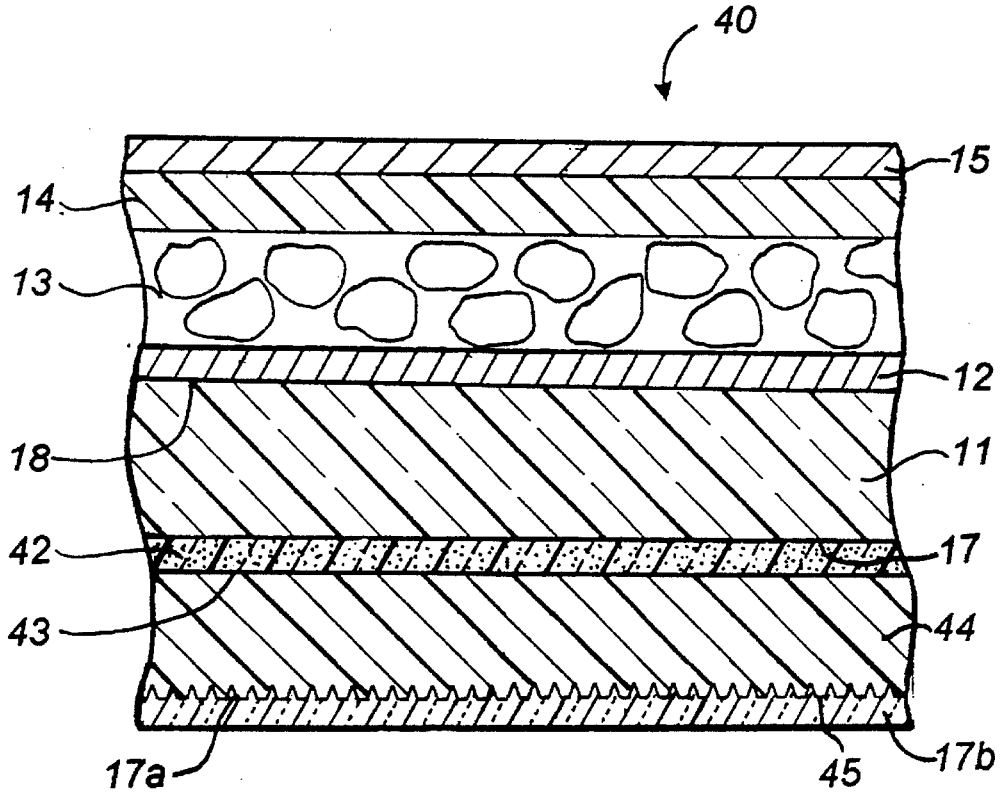
FIG. 6 is an enlarged side elevational view in cross section of an EL lamp in accordance with the third embodiment of the present invention.

In a third embodiment of an EL lamp 40 of the present invention, illustrated in FIG. 6, the top surface 17 of the transparent substrate 11 of FIG. 1 has deposited thereon a layer of transflective material 42. This layer of transflective material 42 is similar to the layer of transflective material 32 shown in FIG. 5. On the top surface 43 (surface away from the transparent substrate 11) of the layer of transflective material 42, a second transparent substrate 44 is deposited. The second transparent substrate 44, which is preferably Mylar™, serves as the face of the EL lamp 40. Therefore, predetermined surface configuration scratches or grooves 17*a* are provided to the top surface 45 of the second transparent substrate 44. Optionally, a layer of lacquer 17*b* and/or indicia can be provided to the top surface 45 of the second transparent substrate 44.

While there have been described what are considered to be the preferred and alternate embodiments of the invention, other modifications of the present invention will occur to those skilled in the art, and it is desired to secure in the appended claims all such modifications as fall within the true spirit and scope of the invention.

We claim:

1. An improved method of manufacturing an electroluminescent lamp having a front side and a back side of the type having a transparent substrate with top and bottom surfaces, and front and back electrodes having interposed therebetween an electroluminescent layer and an insulating layer, wherein the improvement comprises:

adapting the front side of said lamp to reflect incident ambient light and transmit light received from the electroluminescent layer when the electroluminescent layer is energized; and providing the transparent substrate with a predetermined surface configuration on one surface to enhance the diffusion and fringing of the reflected incident ambient light and the light emitted by the electroluminescent layer when energized.

2. An improved method of manufacturing an electroluminescent lamp of the type having a transparent substrate with top and bottom surfaces, and front and back electrodes having interposed therebetween an electroluminescent layer and an insulating layer, wherein the improvement comprises:

adapting the front electrode to reflect incident ambient light and transmit light received from the electroluminescent layer when the electroluminescent layer is energized; and providing the transparent substrate with a predetermined surface configuration on one surface to enhance the diffusion and fringing of the reflected incident ambient light and the light emitted by the electroluminescent layer when energized.

3. The method according to claim 2, which further comprises the step of applying lacquer to the top surface of the transparent substrate.

4. The method according to claim 2, which further comprises the step of providing indicia on the top surface of the transparent substrate.

5. The method according to claim 2, wherein the step of providing the predetermined surface configuration comprises scratching the top surface of the transparent substrate with an abrasive instrument.

6. The method according to claim 5, wherein the abrasive instrument is a metallic brush.

7. The method according to claim 2, wherein the step of adapting the front electrode comprises forming the front electrode out of a layer of aluminum.

8. The method according to claim 7, wherein the layer of aluminum is 500 to 1000 angstroms in thickness.

9. A method for manufacturing an electroluminescent lamp of the type having a transparent substrate with top and bottom surfaces, and front and back electrodes having interposed therebetween an electroluminescent layer and an insulating layer, wherein the improvement comprises:

interposing a layer of transflective material between the front electrode and the electroluminescent layer, the layer of transflective material being adapted to reflect incident ambient light and transmit light received from the electroluminescent layer when the electroluminescent layer is energized; and providing the transparent substrate with a predetermined surface configuration on one surface to enhance the diffusion and fringing of the reflected incident ambient light and the light emitted by the electroluminescent layer when energized.

10. The method according to claim 9, which further comprises the step of applying lacquer to the top surface of the transparent substrate.

11. The method according to claim 9, which further comprises the step of providing indicia on the top surface of the transparent substrate.

12. The method according to claim 9, wherein the step of providing the predetermined surface configuration comprises scratching the top surface of the transparent substrate with an abrasive instrument.

13. The method according to claim 12, wherein the abrasive instrument is a metallic brush.

14. The method according to claim 9, wherein the transflective material comprises aluminum.

15. The method according to claim 14, wherein the layer of transflective material has thickness on the order of 500 angstroms.

16. An improved method of manufacturing an electroluminescent lamp of the type having a first transparent substrate with top and bottom surfaces, and front and back electrodes having interposed therebetween an electroluminescent layer and an insulating layer, wherein the improvement comprises:

providing a layer of transflective material having top and bottom surfaces to the top surface of the first transparent substrate, the layer of transflective material being adapted to reflect incident ambient light and transmit light received from the electroluminescent layer when the electroluminescent layer is energized;

providing a second transparent substrate having top and bottom surfaces to the top surface of the layer of transflective material; and providing the second transparent substrate with a predetermined surface configuration on one surface to enhance the diffusion and fringing of the reflected incident ambient light and the light emitted by the electroluminescent layer when energized.

17. The method according to claim 16, which further comprises the step of applying lacquer to the top surface of the second transparent substrate.

18. The method according to claim 16, which further comprises the step providing indicia on the top surface of the second transparent substrate.

19. The method according to claim 16, wherein the transflective material comprises aluminum.

20. The method according to claim 16, wherein the step of providing the predetermined surface configuration comprises scratching the top surface of the second transparent substrate with an abrasive instrument.

21. The method according to claim 20, wherein the abrasive instrument is a metallic brush.

* * * * *